US006479202B2

(12) United States Patent
Shida et al.

(10) Patent No.: US 6,479,202 B2
(45) Date of Patent: Nov. 12, 2002

(54) ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS AND PROCESSING CARTRIDGE

(75) Inventors: Kazuhisa Shida, Hachioji (JP); Satoshi Uchino, Hachioji (JP); Akihiko Itami, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/812,251

(22) Filed: Mar. 19, 2001

(65) Prior Publication Data

US 2001/0044060 A1 Nov. 22, 2001

(30) Foreign Application Priority Data

Mar. 22, 2000 (JP) ..... 12-080045

(51) Int. Cl.[7] ..... G03G 5/047

(52) U.S. Cl. ..... 430/58.2; 430/66; 430/97; 399/159

(58) Field of Search ..... 430/58.2, 97, 66; 399/159

(56) References Cited

U.S. PATENT DOCUMENTS 6,045,962 A * 4/2000 Kushibiki et al. ..... 430/66
6,258,499 B1 * 7/2001 Itami ..... 430/66

FOREIGN PATENT DOCUMENTS

JP 9190004 7/1997
JP 10251277 9/1998

* cited by examiner

*Primary Examiner*—John Goodrow
(74) *Attorney, Agent, or Firm*—Bierman, Muserlian and Lucas

(57) ABSTRACT

An electrophotographic photoreceptor is disclosed. The photoreceptor has a resin layer comprising a siloxane resin formed by hardening a compound represented by Formula 1, 2 or 3, or a hydrolyzed product which has a structural unit having a charge transportation ability, and a ratio M1/M2 of the sum of the amount in moles M1 of the compound represented by Formula 1 and that represented by Formula 2 to the amount in moles of the compound represented by Formula 3 is within the range of from 0.01 to 1.

$Si(OR_{1'})_4$ Formula 1

$R_1Si(OR_{2'})_3$ Formula 2

$R_1R_2Si(OR_{3'})_2$ Formula 3 wherein the formulas, $R_1$ and $R_2$ each represented an alkyl group having one to ten carbon atoms, a phenyl group, an aryl group, a vinyl group, an amino group, γ-clycidoxypropyl group, a γ-methacryloxypropyl group, or a $C_nF_{2n+1}C_2H_4$— group; $R_{1'}$, $R_{2'}$ and $R_{3'}$ each represented an alkyl group and the groups represented by $R_{1'}$, $R_{2'}$ and $R_{3'}$ may be the same or different from each other.

An image forming method, image forming apparatus, and process cartridge employing the photoreceptor are also disclosed.

10 Claims, 1 Drawing Sheet

ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS AND PROCESSING CARTRIDGE

FIELD OF THE INVENTION

This invention relates to an electrophotographic photoreceptor, an electrophotographic image forming method, an electrophotographic image forming apparatus and a processing cartridge.

BACKGROUND OF THE INVENTION

It has been strongly demanded to inhibit wearing caused by friction with a cleaning blade for raising the durability of an organic photoreceptor. A technique such as providing a strong protective layer on the surface of the photoreceptor has been tried for such the purpose. For example, Japanese Patent Publication Open for Public Inspection, hereinafter referred to JP O.P.I., Nos. 9-190004 and 10-251277 each describe a photoreceptor in which a siloxane resin excellent in the strength is used as the surface layer.

However, the surface layer of the siloxane resin tends to be stripped off since large torque is caused by the cleaning blade under a high temperature and high humid condition.

It is effective to reduce the frictional force between the cleaning blade and the surface layer by reducing the surface energy of the surface layer for preventing the stripping off of the surface layer. For example, JP O.P.I. No. 10-83094 describes a method using a surface layer having a low surface energy such as one having a contact angle with water of not less than 900. However, it is found that the problem cannot be solved only by the introduction of a fluorine atom into the silane compound described in the foregoing publications since the blade torque is depended not only on the chemical affinity but the factor relating to the viscoelastic property of the surface layer.

SUMMARY OF THE INVENTION

The object of the invention is to provide an electrophotographic photoreceptor, an electrophotographic image forming method, an electrophotographic image forming apparatus and a processing cartridge by which the cleaning blade torque is effectively reduced and an apparent image flowing occurred under a high temperature and high humid condition is not occurred, which is a problem relating the hard coat of the photoreceptor.

As a result of studying by the inventors for solving such the problem, it has been found that the torque caused by the blade can be effectively reduced and a desirable property without formation of the considerable flowed image under the high temperature and high humid condition which is the problem to be solved in the hard coat of the photoreceptor can be obtained by the use of the surface layer of the photoreceptor having both of a siloxane cross-linked layer mainly composed of a bifunctional silane compound and a structural unit having an electron transportation ability in stead of a trifunctional silane compound mainly used in the known silicone-type hard coat.

The object of the invention can be attained by the following construction.

An electrophotographic photoreceptor having a resin layer comprising a siloxane resin formed by hardening a compound represented by Formula 1, 2 and 3, or a hydrolyzed product which has a structural unit having a charge transportation ability, wherein a ratio M1/M2 of the sum of the amount in moles M1 of the compound represented by Formula 1 and that represented by Formula 2 to the amount in moles of the compound represented by Formula 3 is within the range of from 0.01 to 1.

The resin layer preferably contains fine particles having a volume average diameter of from 1 nm to 10 Wm.

The resin layer is preferably the surface layer of the photoreceptor.

The siloxane resin is preferably a siloxane resin containing a structure represented by Formula 4.

The photoreceptor preferably has an interlayer between a cylindrical electroconductive substrate and a photosensitive layer.

The resin layer preferably contains an antioxidant.

The photoreceptor is preferably used in an electrophotographic image forming method including processes for electrostatic charging, imagewise exposing, developing and cleaning.

The photoreceptor is preferably used in an electrophotographic image forming apparatus having processes for electrostatic charging, imagewise exposing, developing and cleaning.

It is preferable that the photoreceptor is combined with any one of a charging means, an imagewise exposing means, a developing means and a cleaning means to form an unitized processing cartridge to be used in an electrophotographic image forming apparatus comprising the photoreceptor, a charging means, an imagewise exposing means, a developing means and a cleaning means, and the cartridge is designed for capable of freely inserted into the electrophotographic image forming apparatus.

DETAILED DESCRIPTION OF THE INVENTION

Figure 1:
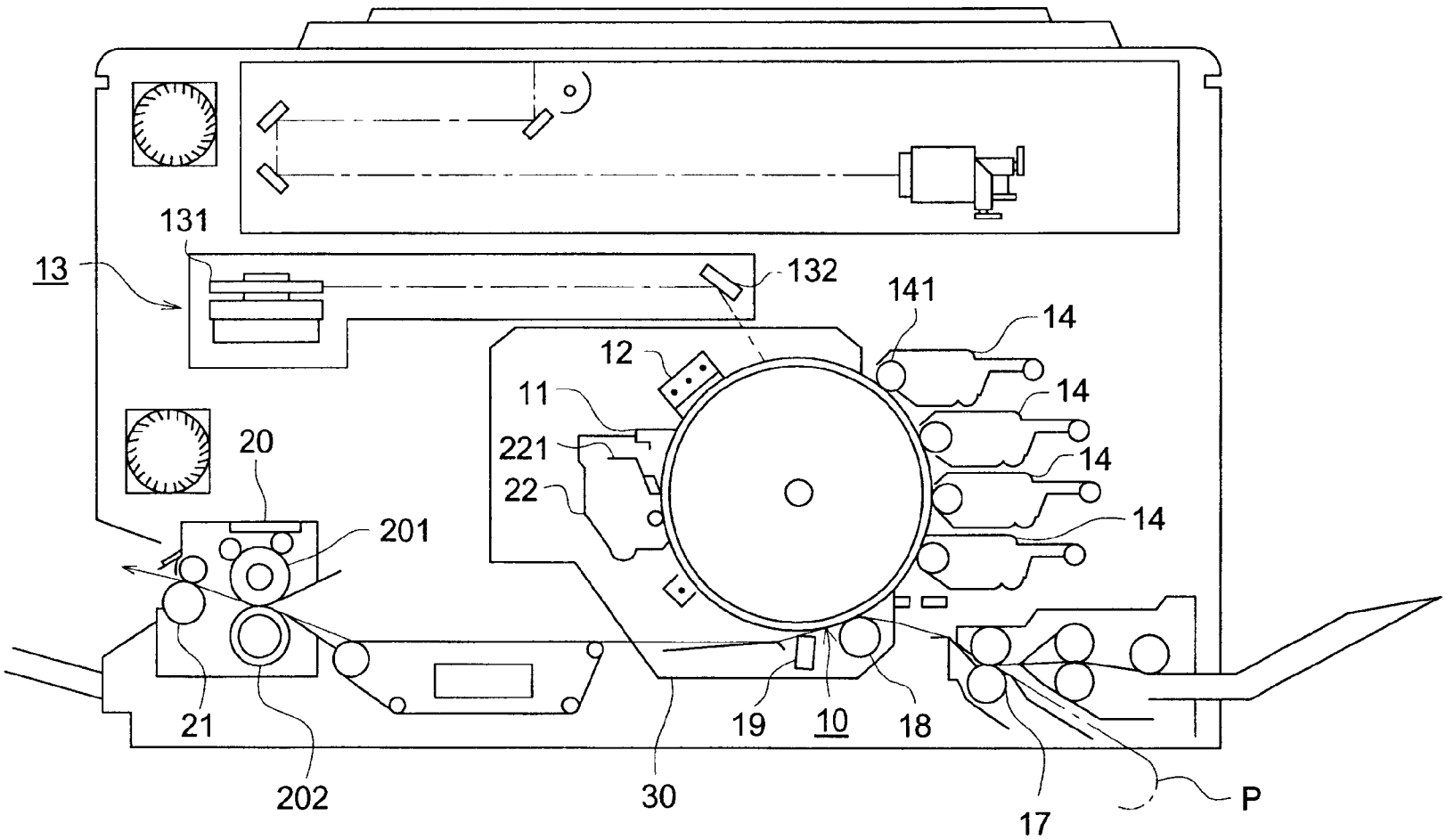
FIG. 1 shows a cross-sectional view of an image forming apparatus comprising the electrophotographic photoreceptor of the present invention.

The siloxane resin to be used in the invention is produced by using an organic silicon compound having a hydrolyzable group represented by the following Formula 1, 2 or 3.

$$Si(OR_{1'})_4 \qquad \text{Formula 1}$$

$$R_1Si(OR_{2'})_3 \qquad \text{Formula 2}$$

$$R_1R_2Si(OR_{3'})_2 \qquad \text{Formula 3}$$

In the formulas, $R_1$ and $R_2$ each represented an alkyl group having one to ten carbon atoms, a phenyl group, an aryl group, a vinyl group, an amino group, a γ-glycidoxypropyl group, a γ-methacryloxypropyl group, or a $C_nF_{2n+1}C_2H_4$— group. $R_{1'}$, $R_{2'}$ and $R_{3'}$ each represented an alkyl group and the groups represented by $R_{1'}$, $R_{2'}$ and $R_{3'}$ may be the same or different from each other.

A hydrolyzed product which is prepared by hydrolyzing the foregoing silicon compound under an acidic or basic condition to form an oligomer or polymer, can be also usable as the raw material of the siloxane resin.

The siloxane resin to be used in the invention forms a resin layer with a high hardness by forming a cross-linking in a part of the siloxane-containing cross-likable raw material of the resin in the coating liquid or in the coating and drying process thereof.

When the surface layer is formed by the siloxane resin, colloidal silica may be contained to form a surface layer including the colloidal silica as a part of the cross-linking structure.

The torque caused by the blade can be more effectively reduced by containing a fine particle such as colloidal silica and colloidal titania each having an average particle diameter of from 1 nm to 10 μm, preferably from 5 nm to 5 μm in the resin layer.

The followings are examples of an organic or inorganic particle each can be used together with the foregoing colloidal silica or in the place of the colloidal silica.

Examples of the organic particle include a particle of a silicone resin, a polytetrafluoroethylene, a poly(vinylidene fluoride), a poly(ethylene trifluorochloride), a poly(vinyl fluoride), a copolymer of ethylentetrafluoride and perfluoroalkyl vinyl ether, a copolymer of ethylenetetrafluoride and propylene hexafluoride, a copolymer of ethylene and ethylene trifluoride, a copolymer of ethylene tetrafluoride, propylene hexafluoride and perfluoroalkyl vinyl ether, a polyethylene, a poly(vinyl chloride), a metal stearate, a poly(methyl methacrylate) and a melamine. The volume average diameter thereof is preferably from 1 nm to 5 μm, more preferably from 1 nm to 500 nm. The amount of the organic particle to be contained in the resin layer of the invention is preferably from 0.1 to 100%, more preferably from 1 to 50%, by weight of the amount of the binder resin in the resin layer.

Examples of the inorganic particle include a particle Of a metal oxide such as magnesium oxide, calcium oxide, titanium oxide, zirconium oxide, tin oxide, aluminum oxide, silicon oxide (silica), indium oxide, beryllium oxide, lead oxide and bismuth oxide, a nitride such as boron nitride, aluminum nitride and silicon nitride, and a carbide such as silicon carbide and boron carbide. The inorganic particle may be subjected to a hydrophobilizing treatment by a hydrophobilizing agent such as a titanium coupling agent, silane coupling agent, an aluminum coupling agent and a high molecular weight fatty acid.

The particle diameter of the inorganic particle is preferably from 1 nm to 5 μm, more preferably from 1 nm to 500 nm, in the volume average diameter. The amount of the inorganic particle to be contained in the surface layer of the photoreceptor is preferably from 0.1 to 100%, more preferably from 1 to 50%, by weight of the amount of the binder resin in the surface layer.

The volume average diameter of the organic and inorganic particles can be measured by laser diffraction/scattering grain size distribution analyzer LA-700 manufactured by Horiba Seisakusyo Co. Ltd.

Rising of remaining potential and burring of image can be effectively prevented by adding an antioxidant into the siloxane resin layer.

The charge transportable structural unit is defined as a chemical structural unit or a residue of charge transportable compound by which an electric current caused by charge transportation can be detected by a known method for detecting the charge transportation ability such as Time-Of-Flight method. In the invention the cross-linked siloxane resin having a charge transportable structural unit is a siloxane resin in which a chemical structure showing a drift mobility of electron or a hole (i.e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalono-nitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units (X in Formula 4) are residues of usually used charge transporting compounds such as mentioned above. The residue is bonded with the bonding atom or group represented by Y through the carbon atom or the silicon atom constituting the charge transporting compound so as to be contained in the siloxane resin.

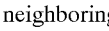

—Si—Y—X Formula 4

Y is an atom having two or more valences eliminating neighboring bonding group. When Y is three or more valent atom, the bonding hand other than those each bonding with Si and C is bonded with any atom constituting the hardened resin, or another atom or molecular group.

In the above-mentioned formula, the atom represented by Y is preferably an oxygen atom O, a sulfur atom S or nitrogen atom N.

While the structural unit having charge transportability X, i.,e., a group giving charge transportability, is shown as a mono-valent group in the above formula, it may connect as two or more valent cross-linking group in the hardenable resin in case that the transportable compound has two or more reactive functional group to be react with the hardenable siloxane resin, or may simply connect as a pendant group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also compounds having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_1—OH)_m \quad m \leqq 1$$

wherein

X: structural unit providing charge transportability $R_1$: single bonding group, each of a substituted or an unsubstituted alkylene or arylene group m: preferably 1 to 5.

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

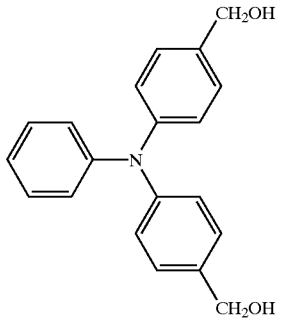

T-2

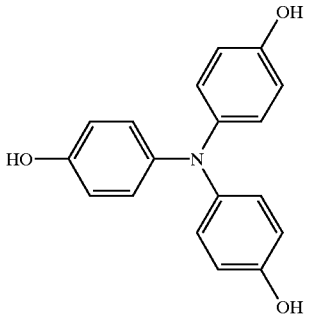

T-3

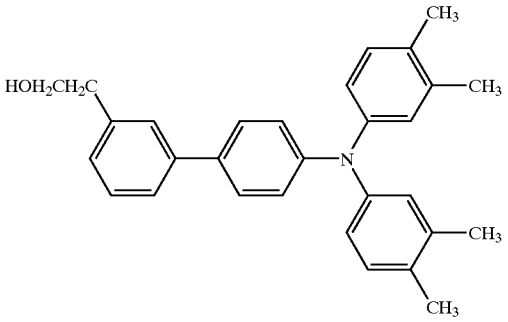

-continued

T-4

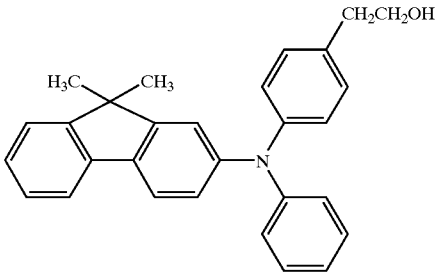

2. Hydrazine Based Compounds

H-1

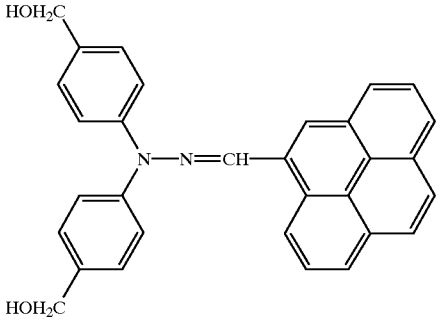

H-2

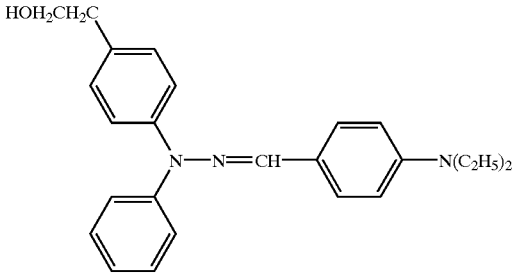

H-3

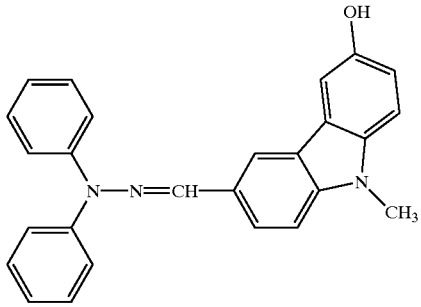

3. Stilbene Based Compounds

S-1

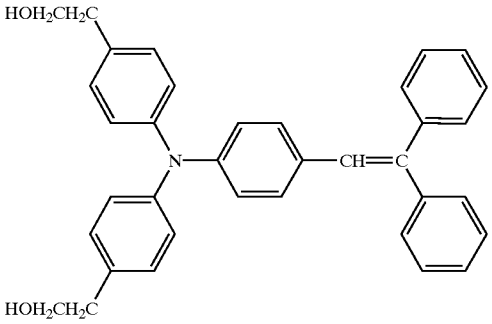

-continued

S-2

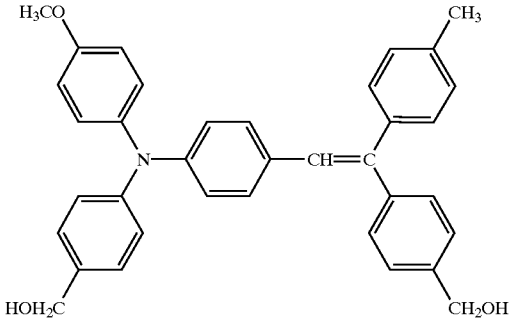

S-3

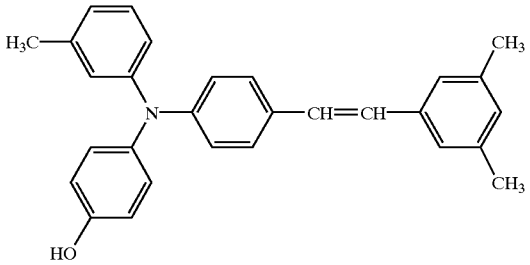

4. Benzidine Based Compounds

Be-1

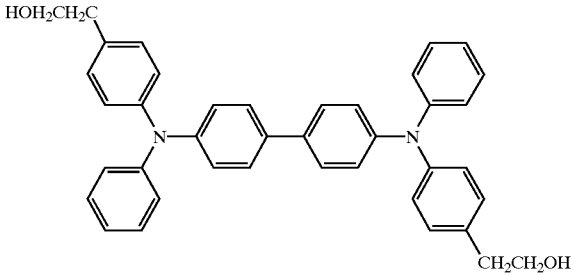

Be-2

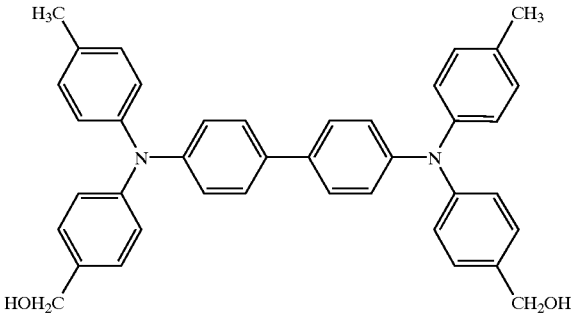

-continued

5. Butadiene Based Compounds

Bu-1

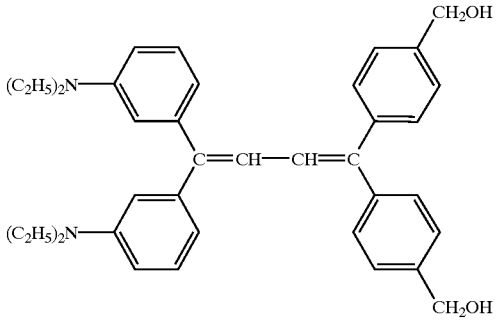

6. Other Compounds

So-1

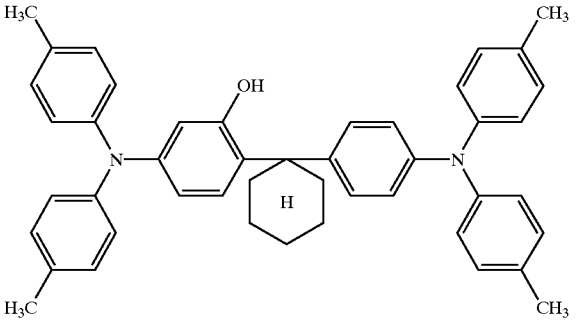

So-2

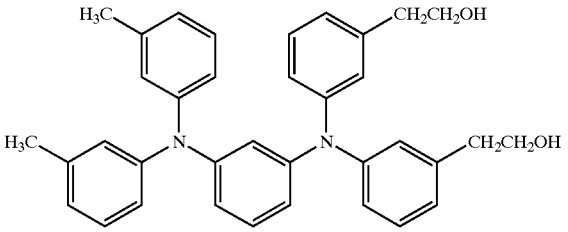

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_1—SH)_m \quad m \leq 1$$

wherein

X: charge transportability providing group $R_1$: single bonding group, a substituted or unsubstituted alkylene or arylene group m: preferably 1 to 5.

Of these, listed as representative compounds are such as those described below.

V-1

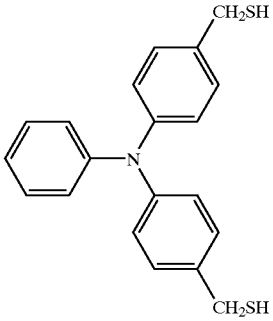

V-2

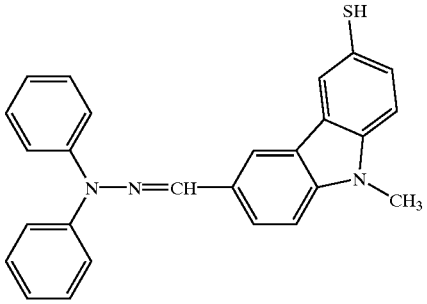

V-3

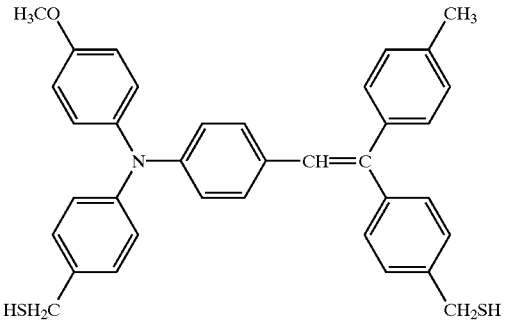

-continued

V-4

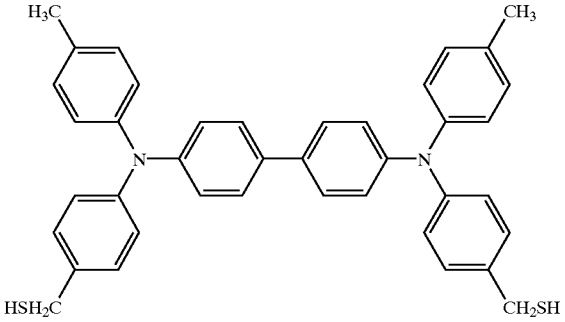

V-5

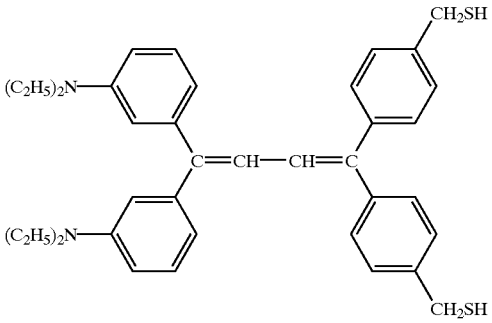

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_1—NR_2H)_m \quad m \leqq 1$$

wherein

X: charge transportability providing group $R_1$: single bonding group, a substituted or unsubstituted alkyl group or a substituted or an unsubstituted aryl group $R_2$: H, a substituted or unsubstituted alkyl group, or a substituted or unsubstituted aryl group m: 1 to 5.

Of these, listed as representative compounds are such as those described below.

W-1

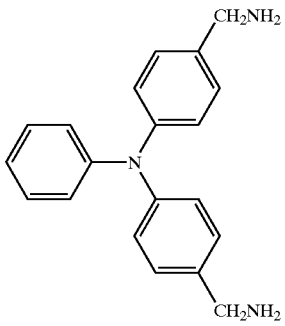

-continued

W-2

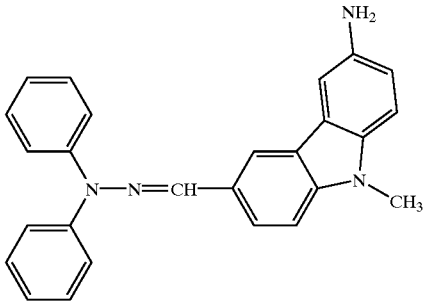

W-3

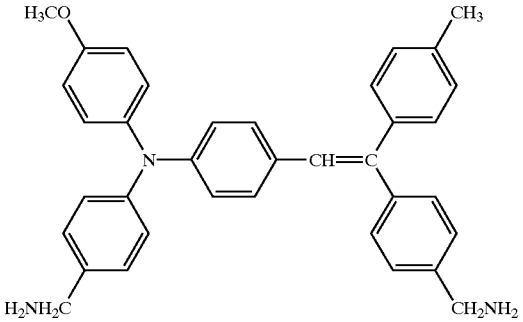

W-4

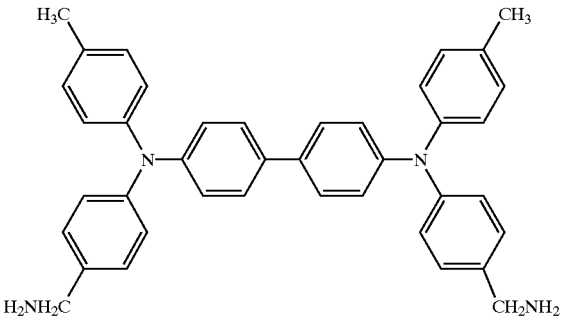

W-5

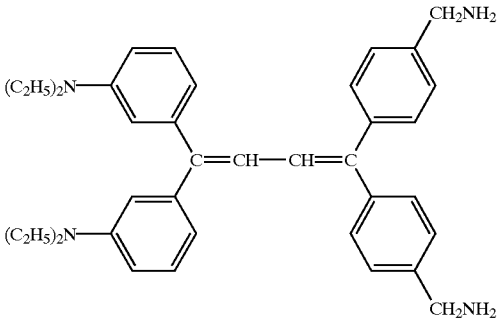

-continued

W-6

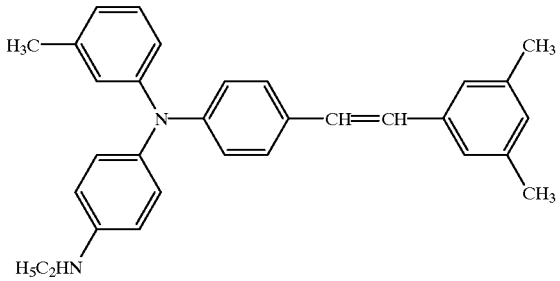

Of charge transportable compounds having an amino group, in the case of primary amine compounds (—$NH_2$), two hydrogen atoms may react with the organic silicone compound, and bonding to the siloxane structure may take place.

In the case of secondary amine compounds (—NHR), one hydrogen atom may react with the organic silicone compound, and the remaining R may be any of a remaining group as a branch, a group resulting in a crosslinking reaction, or a compound group having charge transportability.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octate, dibutyl tin dictate, dibutyl tin dilaurate, dibutyl tin mercaptide, dibutyl tin thiocarboxylate and dibutyl tin maleate, an aluminum or zinc salt of octenic acid or naphthenic acid and an acetylacetone complex.

Further, antioxidants having a partial structure of hindered phenol, hindered amine, thioether, or phosphite may be incorporated into the resin layer of the present invention, and are effective for the improvement of potential stabilization during ambient variation, as well as image quality.

Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63 Thioether type antioxidant: Sumilizer TPS and Sumilizer TP-D Phosphite type antioxidant: Mark 2112, Mark PEP 8, Mark PEP 24G, Mark PEP 36, Mark 329K and Mark HP 10.

Among those, preferable are hindered phenol type and hindered amine type particularly.

The added amount of antioxidants is preferably between 0.1 and 100 weight parts per 100 weight parts of the total resin layer composition.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:5 and 5:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 $\mu$m, and is more preferably between 10 and 40 $\mu$m. Furthermore, when a plurality of charge transport layers are provided, the thickness of the upper charge transport layer is preferably no more than 10 $\mu$m, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention are:

1) metal plates such as an aluminum plate, a stainless steel plate, and the like
2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

The electrically conductive support of the electrophotographic photoreceptor of the present invention is one in which a sealed alumite film on its surface is formed.

An alumite film forming process is generally carried out in an acidic bath comprising, for instance, chromic acid, sulfuric acid, oxalic acid, phosphoric acid, boric acid, sulfamic acid, and the like. Of these, the anodic oxidation in sulfuric acid results in the most preferred form. The anodic oxidation in sulfuric acid is preferably carried out at a sulfuric acid concentration of 100 to 200 g/liter, an aluminum ion concentration of 1 to 10 g/liter, a temperature of about 20° C., and an electrolytic voltage of about 20 volts. Further, the average thickness of the layer formed by said anodic oxidation is commonly no more than 20 $\mu$m, and is preferably no more than 10 $\mu$m.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 $\mu$m, and is most preferably between 0.1 and 5 $\mu$m.

In the photoreceptor of the invention a conductive layer may be provided between the support and the inter layer for the purposes of providing a coating to compensate surface defects of the surface of the support and preventing of occurrence of interference mottle which becomes problematic when the image writing source is laser light. The conductive layer can be formed by coating a composition in which conductive powder such as carbon black, metal particles or metal oxide particles are dispersed in suitable binder resin and drying it. The thickness of the conductive layer is preferably 5 to 40 $\mu$m, particularly 10 to 30 $\mu$m.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

FIG. 1 shows a cross-sectional view of an image forming apparatus comprising the electrophotographic photoreceptor of the present invention.

In FIG. 1, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 1 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the FIGURE, so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The present electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The invention is described in detail below according to examples.

Preparation of Photoreceptor 1

| Subbing layer | |
|---|---|
| Titanium chelating compound TC-750 (Matsumoto Seiyaku Co., Ltd.) | 30 g |
| Silane coupling agent KBM-503 (Shin'etsu Kagaku Co., Ltd.) | 17 g |
| 2-propanol | 150 ml |

The above-mentioned coating liquid was coated on an electroconductive substrate having a diameter of 60 mm so as to form a layer having a thickness of 0.5 μm.

| Charge generation layer | |
|---|---|
| Y-type titanylphthalocyanine | 60 g |
| Silicone-modified butyral resin X-40-1211 (Shin'etsu Kagaku Co., Ltd.) | 700 g |
| 2-butanone | 2000 ml |

The above-mentioned components were mixed and dispersed for 10 hours by a sand mill to prepare a charge generating layer coating liquid. The coating liquid was coated on the foregoing subbing layer by a immersion method to form a charge generation layer having a thickness of 0.2 μm.

| Charge transportation layer: | |
|---|---|
| Charge transportation substance D-1 | 225 g |
| Polycarbonate (Viscosity average molecular weight: 30,000) | 300 g |
| Dichloromethane | 2000 ml |

The above components were dissolved to prepare a charge transportation layer coating liquid. The coating liquid was coated on the foregoing charge generation layer by a immersion method to form a charge generation layer shown in Table 1 having a thickness of 20 μm.

D1

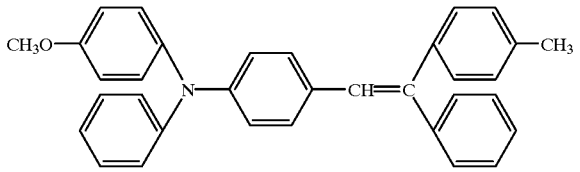

| Resin layer | |
|---|---|
| Phenyltrimethoxysilane | 15 g |
| Dimethoxydimethylsilane | 145 g |
| Compound T-1 | 52 g |
| Antioxidant Sanol LS2626 (Sankyo Co., Ltd.) | 2.6 g |
| Ethanol | 280 g |
| 4% acetic acid | 31 g |
| Aluminum trisacetylacetonate | 2 g |

The above-mentioned components were mixed to prepare a coating liquid of a resin layer. The coating liquid was coated on the foregoing charge transportation layer by a circle type coating amount controlling coating apparatus to form a resin layer having a thickness of 3 μm. The coated layer was hardened at 110° C. for 1 hour to form a siloxane resin layer having a cross-linking structure. Thus Photoreceptor 1 was prepared.

Preparation of Photoreceptor 2

Photoreceptor 2 was prepared in the same manner as in Photoreceptor 1 except that the amounts of phenyltrimethoxysilane, dimethoxydimethylsilane and 4% acetic acid were each changed to 30 g, 130 g and 31.4 g, respectively.

Preparation of Photoreceptor 3

Photoreceptor 3 was prepared in the same manner as in Photoreceptor 1 except that the amounts of phenyltrimethoxysilane, dimethoxydimethylsilane and 4% acetic acid were each changed to 80 g, 80 g and 32.7 g, respectively.

Preparation of Photoreceptor 4

Photoreceptor 4 was prepared in the same manner as in Photoreceptor 2 except that 100 g of colloidal silica in a form of 30% methanol solution of methanol silica sol was added to the resin layer coating liquid.

Preparation of Photoreceptor 5

Photoreceptor 5 was prepared in the same manner as in Photoreceptor 2 except that 100 g of zirconia sol NZS-30A, 30.7% aqueous solution, manufactured by Nissan Kagaku Co., Ltd., was added to the resin layer coating liquid.

Preparation of Photoreceptor 6

Photoreceptor 6 was prepared in the same manner as in Photoreceptor 2 except that 30 g of a melamine-formaldehyde condensation product Epostar S manufactured by Nihon Syokubai Co., Ltd., was added to the resin layer coating liquid.

Preparation of Photoreceptor 7

Photoreceptor 7 was prepared in the same manner as in Photoreceptor 4 except that 30 g of phenyltrimethoxysilane in the resin layer coating liquid was replaced by 40 g of trimethoxymethylsilane.

Preparation of Photoreceptor 8

Photoreceptor 8 was prepared in the same manner as in Photoreceptor 4 except that 30 g of phenyltrimethoxysilane in the resin layer coating liquid was replaced by 35 g of trimethoxypropylsilane.

Preparation of Photoreceptor 9

Photoreceptor 9 was prepared in the same manner as in Photoreceptor 2 except that the antioxidant in the resin layer was omitted.

Preparation of Photoreceptor 10

Photoreceptor 10 was prepared in the same manner as in Photoreceptor 1 except that the amounts of phenyltrimethoxysilane and dimethoxydimethylsilane in the resin layer coating liquid were each changed to 155 g and 16 g, respectively, and the antioxidant in the resin layer was omitted.

Preparation of Photoreceptor 11

Photoreceptor 11 was prepared in the same manner as in Photoreceptor 1 except that the amount of phenyltrimethoxysilane in the resin layer coating liquid was changed to 162 g, respectively, and dimethoxydimethylsilane and the antioxidant in the resin layer were omitted.

Preparation of Photoreceptor 12

Photoreceptor 12 was prepared in the same manner as in Photoreceptor 1 except that the amounts of phenyltrimethoxysilane and dimethoxydimethylsilane in the resin layer coating liquid were each changed to 120 g and 36 g, respectively, and the antioxidant in the resin layer was omitted.

Evaluation of the Image Property and the Starting Torque of Drum

Thus prepared photoreceptors were each installed in a digital copying machine Konica 7040, manufactured by Konica Corp., having processes of laser exposing, reversal developing, separating by crow and cleaning by blade, and subjected to a continuous copying by 200,000 sheets of A4 size plain paper for practical copying evaluation under a high temperature and humid condition at 30° C. and 80% RH. The initial charge potential was set at −750 V.

An original image including four parts each having a character image having an image ratio of 7%, a portrait image, a solid white image, a solid black image was copied by A4 size plain paper, and the quality of copies of the half tone image, solid white and solid black image were evaluated every 1,000th copies.

For evaluating the starting torque of the drum and the stripping off of the photoreceptor layer by the blade, the photoreceptor was installed in a drum cartridge of the digital copying machine Konica 7040 and the photoreceptor was fixed by the center axis, and a cleaning blade was contacted to the photoreceptor with a touching angle of 10° and a digging depth of 1.5 mm. The starting torque of the drum and the stripping of the photoreceptor layer were evaluated at the time of initiation and every 100,000th copies.

Status of the stripping of the photoreceptor layer by the blade

A: The photoreceptor layer was not stripped until 200,000th copy.

B: The photoreceptor layer was not stripped until 100,000th copy.

C: The photoreceptor layer was stripped before 100,000th copy.

Image Forming Property

A: No failed image was formed until 200,000th copy.

B: No failed image was formed until 100,000th copy.

C: 1 to 4 failed images were formed until 100,000th copy.

D: 5 or more failed images were formed until 100,000th copy.

| Photo-receptor No. | Status of striping off by blade | Image forming property | Photoreceptor driving torque: Initi-ation time | After 100,000 copies | After 200,000 copies |
|---|---|---|---|---|---|
| 1 | B | A | 40 | 34 | 34 |
| 2 | B | A | 42 | 34 | 34 |
| 3 | B | A | 45 | 37 | 36 |
| 4 | A | A | 35 | 26 | 24 |
| 5 | A | A | 36 | 30 | 29 |
| 6 | A | A | 36 | 31 | 29 |
| 7 | A | A | 36 | 26 | 23 |
| 8 | A | A | 35 | 26 | 23 |
| 9 | A | C | 42 | 34 | 34 |
| 10 | C | D | 49 | 45 | 44 |
| 11 | C | C | 48 | 48 | 49 |
| 12 | C | D | 46 | 43 | 44 |

It is appeared from Table 1 that the desirable properties are obtained when the ratio M1/M2 of the sum of the amount in moles M1 of the compound represented by formula 1 and that represented by Formula 2 and the amount in moles M2 of the compound represented by Formula 3 is within the range of from 0.01 to 1.0 such as in Photoreceptors 1 to 9.

Among them, ones containing the fine particles and the antioxidant give better results in the image forming properties and the reduction of the torque caused by the blade. Besides, the failed image and stripping off of the photoreceptor layer caused by the blade are occurred in the photoreceptors without the invention, Photoreceptors 10 to 12. Accordingly, it is understood that the effects of the invention cannot be obtained in the photoreceptor without the invention.

The torque caused by the cleaning blade can be effectively reduced by the invention, and an electrophotographic photoreceptor, an electrophotographic image forming method, an electrophotographic image forming apparatus and a processing cartridge can be provided by which the cleaning blade torque is effectively reduced and an apparent image flowing occurred under a high temperature and high humid condition is not formed, which is a problem of the hard coat of the photoreceptor.

What is claimed is:

1. An electrophotographic photoreceptor having on a support, a resin layer comprising a siloxane resin formed by hardening a compound represented by Formula 1, 2 or 3, or a hydrolyzed product which has a structural unit having a charge transportation ability, wherein a ratio M1/M2 of the sum of the amount in moles M1 of the compound represented by Formula 1 and that represented by Formula 2 to the amount in moles of the compound represented by Formula 3 is within the range of from 0.01 to 1.

$$Si(OR_{1'})_4 \quad \text{Formula 1}$$

$$R_1Si(OR_{2'})_3 \quad \text{Formula 2}$$

$$R_1R_2Si(OR_{3'})_2 \quad \text{Formula 3}$$

wherein the formulas, $R_1$ and $R_2$ each represented an alkyl group having one to ten carbon atoms, a phenyl group, an aryl group, a vinyl group, an amino group, a γ-clycidoxypropyl group, a γ-methacryloxypropyl group, or a $C_nF_{2n+1}C_2H_4$— group; $R_{1'}$, $R_{2'}$ and $R_{3'}$ each represented an alkyl group and the groups represented by $R_{1'}$, $R_{2'}$ and $R_{3'}$ may be the same or different from each other.

2. The electrophotographic photoreceptor of claim 1, wherein the resin layer contains fine particles having a volume average diameter of from 1 nm to 10 μm.

3. The electrophotographic photoreceptor of claim 1, wherein the resin layer is a surface layer of the photoreceptor.

4. The electrophotographic photoreceptor of claim 1, wherein the resin layer is a siloxane resin containing a structure represented by Formula 4, $$\text{—Si—Y—X} \quad \text{Formula 4}$$

wherein X is a unit having charge transportability, Y is an atom having two or more valences eliminating neighboring bonding group.

5. The electrophotographic photoreceptor of claim 1, wherein the substrate is a cylindrical electroconductive substrate.

6. The electrophotographic photoreceptor of claim 5, wherein the photoreceptor has an interlayer between the cylindrical electroconductive substrate and a photosensitive layer.

7. The electrophotographic photoreceptor of claim 1, wherein the resin layer contains an antioxidant.

8. An electrophotographic image forming method including electrostatic charging on a photoreceptor, imagewise exposing on the photoreceptor to form a latent image, developing the latent image by a developer and cleaning residual toner on the photoreceptor, wherein the electrophotographic photoreceptor has on a support, a resin layer comprising a siloxane resin formed by hardening a compound represented by Formula 1, 2 or 3, or a hydrolyzed product which has a structural unit having a charge transportation ability, wherein a ratio M1/M2 of the sum of the amount in moles M1 of the compound represented by Formula 1 and that represented by Formula 2 to the amount in moles of the compound represented by Formula 3 is within the range of from 0.01 to 1.

$$Si(OR_{1'})_4 \quad \text{Formula 1}$$

$$R_1Si(OR_{2'})_3 \quad \text{Formula 2}$$

$$R_1R_2Si(OR_{3'})_2 \quad \text{Formula 3}$$

wherein the formulas, $R_1$ and $R_2$ each represented an alkyl group having one to ten carbon atoms, a phenyl group, an aryl group, a vinyl group, an amino group, a γ-clycidoxypropyl group, a γ-methacryloxypropyl group, or a $C_nF_{2n+1}C_2H_4$— group; $R_{1'}$, $R_{2'}$ and $R_{3'}$ each represented an alkyl group and the groups represented by $R_{1'}$, $R_{2'}$ and $R_{3'}$ may be the same or different from each other.

9. An image forming apparatus comprising an electrophotographic photoreceptor, a charging device, an image exposure device, a development device, and a cleaning device, wherein the electrophotographic photoreceptor is that of claim 1.

10. A processing cartridge employed in an image forming apparatus comprising a charging device, an image exposure device, a development device and a cleaning device, wherein the process cartridge has an integral combination of the photoreceptor of claim 1, with any one of a charging device, exposure device, a development device, and a cleaning device, and is free to be mounted on and to be dismounted from said image forming apparatus.

* * * * *